United States Patent [19]

Breslow

[11] 4,000,899

[45] Jan. 4, 1977

[54] GAME DEVICE

[75] Inventor: Jeffrey D. Breslow, Highland Park, Ill.

[73] Assignee: Marvin Glass & Associates, Chicago, Ill.

[22] Filed: May 16, 1975

[21] Appl. No.: 578,004

[52] U.S. Cl. ..... 273/101; 124/4

[51] Int. Cl.[2] ..... A63F 7/10

[58] Field of Search ..... 273/119 R, 119 A, 120 R, 273/120 A, 37, 38, 39, 101, 129; 124/4

[56] References Cited

UNITED STATES PATENTS

| | | | |
|---|---|---|---|
| 85,539 | 1/1869 | Seher | 273/120 R |
| 497,910 | 5/1893 | Davids | 273/119 R |
| 593,421 | 11/1897 | Mumbrauer | 273/38 |
| 957,740 | 5/1910 | Burke | 273/120 A |

FOREIGN PATENTS OR APPLICATIONS

| | | | |
|---|---|---|---|
| 73,841 | 2/1894 | Germany | 273/52 |
| 122,157 | 1/1919 | United Kingdom | 273/119 R |
| 140,320 | 3/1920 | United Kingdom | 273/38 |

*Primary Examiner*—Anton O. Oechsle
*Attorney, Agent, or Firm*—Coffee and Sweeney

[57] ABSTRACT

A game device having a game board, the top of which defines a playing area with a plurality of positions on the game board 360° about a ball propelling device rotatably mounted on the game board for continuous and uniform rotation 360° generally centrally of the playing area. Boss type positions are provided on the playing area and are coded for receiving a plurality of identically coded upright target members about the ball propelling device. The ball propelling device is continuously and uniformly rotated during play of the game by a battery operated motor whereby a player may selectively, at any given time, place a ball in the propelling device and have the device immediately project the ball outwardly therefrom over the playing area toward the upstanding target members whereby a player can effectively aim his "shot" of a ball by properly timing the placing of the ball in the propelling device as it is rotated in an attempt to knock over selected ones of said upstanding target members.

2 Claims, 3 Drawing Figures

28
16
10
2
18
24
22
32
20
14
30
24
22
56
22
12
2

28
16

30
32
20
44
38
36
52
22
18
40
54
48
26
14
3
34
50
3
42
56
24
12
46

60
62

52
50
54
48
14
46
24
34
70
44
56
72
12
42
40
68
46
22
66
18
64

GAME DEVICE

BACKGROUND AND SUMMARY OF THE INVENTION

This invention relates to games or game apparatus and particularly to a game device adapted to require timing and manual manipulation of propelling balls into a ball propelling device for knocking over upright target members which are coded for the various players of the game.

Various games of the character described are known wherein spinners are used to propel balls or other objects radially outwardly under centrifugal force toward an annular series of ball receiving recesses, or the like, the recesses usually extending 360° about the spinner which is pivotally mounted generally centrally of the recesses. Usually, such recesses are identified by different values of standard card indicia of the respective cards of a given set of playing cards. However, the ball projected by the projecting device usually can rebound back and forth and there is an element of chance so as to have a ball drop into a particular recess, eventually, so as to identify a particular card value.

An object of the present invention, therefore, is to provide a new and improved mechanized game of the character described which is more positive in the degree of timing and articulate manipulation for projecting balls toward the intended goals.

In the exemplary embodiment of the invention, a plurality of upstanding bosses are provided on the playing board about an elevated ball propelling device which is rotated continuously and uniformly 360° for directing balls outwardly therefrom. A plurality of upstanding target members are positionable by recesses on the underside thereof over the upstanding bosses so that they can be knocked over by players of the game depositing balls in timed relation into the ball propelling device which is elevated from the playing area.

In the preferred embodiment, the bosses which define the positions for the upstanding target members are coded identical to codings on the upstanding target members so as to define specific positions for the target members about the ball propelling device. For instance, the target members may be color coded for individual players of the game whereby the object of the game is for a player to attempt to knock over all of the other players' coded target members so that one of his own coded target members is the last to be standing upright on the playing area. Of course, other schemes of play are contemplated.

Other objects, features and advantages of the invention will be apparent from the following detailed description taken in connection with the accompanying drawings.

DETAILED DESCRIPTION OF THE INVENTION

Figure 1:
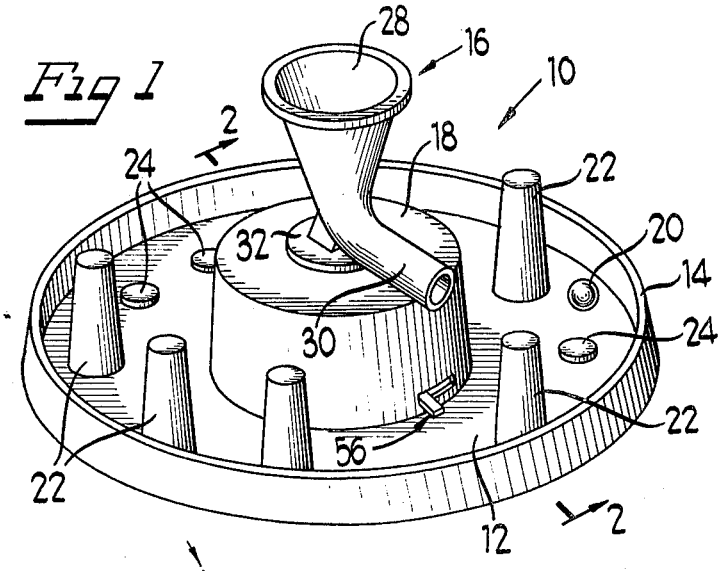
FIG. 1 is a perspective view of the game device of the present invention.
Figure 2:
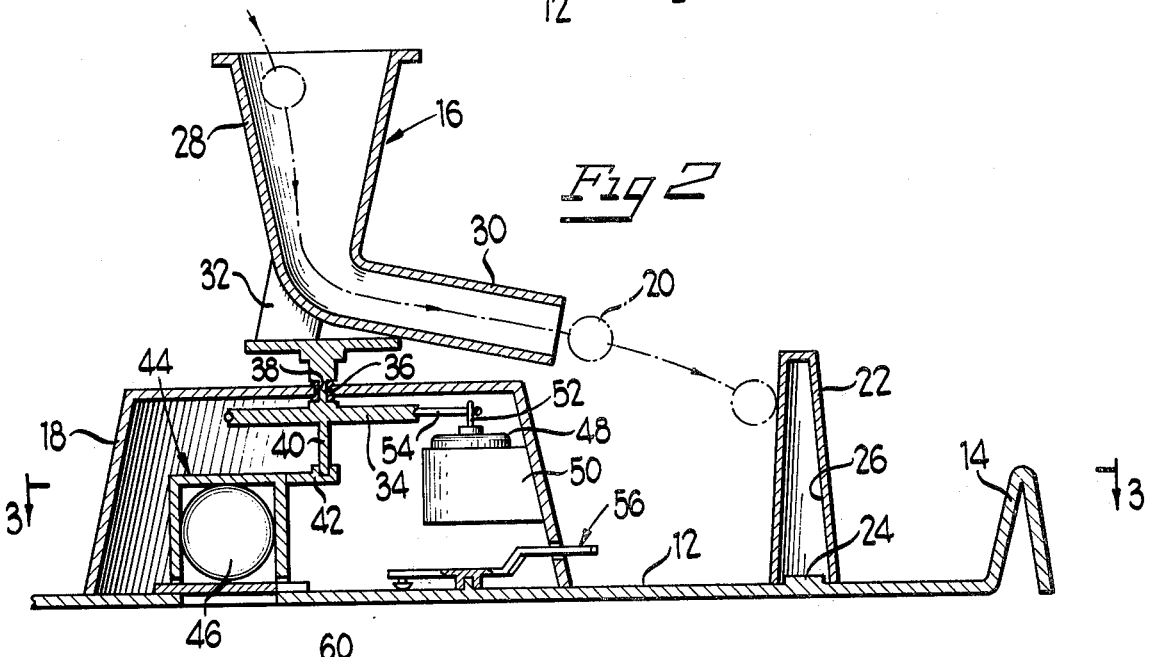
FIG. 2 is a vertical, fragmentary sectional view, on an enlarged scale, taken generally along line 2—2 of FIG. 1.

Referring to the drawings in greater detail, the game device of the present invention, generally designated 10 in FIG. 1, includes a game board 12, the top of which defines a playing area with retaining wall means 14 thereabout. A rotary ball propelling device, generally designated 16, is mounted on a housing 18 so as to be elevated above the game board 12. The housing 18 is shown in FIG. 2 as being generally hollow so as to house power means, to be described in greater detail hereinafter, for rotating the ball propelling device 16 continuously and uniformly 360° so as to propel a ball 20 radially outwardly therefrom in a timed relationship so that a player can effectively aim his "shot" by properly timing the placing of a ball in the propelling device.

The general object of the game is for a player to drop a ball 20 into the ball propelling device 16 and have the ball immediately projected from the ball propelling device radially outwardly therefrom toward a plurality of upstanding target members 22 in an attempt to knock over the target members.

Referring first to the target members 22 and their respective positions on the game board 12, there are provided a plurality of bosses 24 equally spaced, 360° angularly about the ball propelling device 16 on the game board 12. As can be seen best in FIG. 2, the upstanding target members 22 are generally hollow on the inside so as to define a bottom recess 26 (FIG. 2) which is positionable over specific ones of the bosses 24. As stated above, the ball propelling device 16 is elevated by the housing 18 above the game board 12 so that a ball (as shown in FIG. 2) strikes one of the upstanding targets 22 at points above the playing board to facilitate knocking over the target members.

In one scheme of playing the game, the bosses 24 are coded (as by colors) for individual players of the game and the upstanding target members 22 are identically coded so as to be properly positioned over the proper bosses 24 on the game board. In this manner, various rules for playing the game are available. For instance, the players of the game may take turns by dropping their ball into the ball propelling device in an attempt to knock over target members 22 which are coded to the opposing players of the game, whereby the object is to have one of your own coded target members to be the last target member upstanding on the game board 12. Vice versa, the rules may provide that the winner of the game is the first player to knock over all of his own coded target members.

Referring to the ball propelling device 16, in particular, as best seen in FIG. 2, the ball propelling device includes an upper downwardly converging funnel portion 28 which is in direct communication with a generally horizontal, but slightly downwardly canted chute portion 30. This structure is mounted by way of a bracket 32 to a pulley member 34 which is disposed within the housing 18. The pulley member 34 is connected to the bracket member 32 by means of a shaft portion 36 extending through an aperture 38 in the top of the housing 18. A stub shaft portion 40 extends downwardly from the pulley portion 34 and is journalled in a flange 42 of a battery housing, generally designated 44. Batteries 46 are disposed within the battery housing 44.

An electric motor 48 is mounted by a bracket 50 within the housing 18 and has a drive shaft 52 protruding upwardly therefrom. A drive belt 54 is wrapped about the pulley 34 and the drive shaft 52 for rotating the ball propelling device 16 continuously and uniformly 360° during operation of the motor. An on-off switch, generally designated 56 (FIG. 2) is provided for turning the motor on and off so as to selectively energize the ball propelling device 16.

Figure 3:
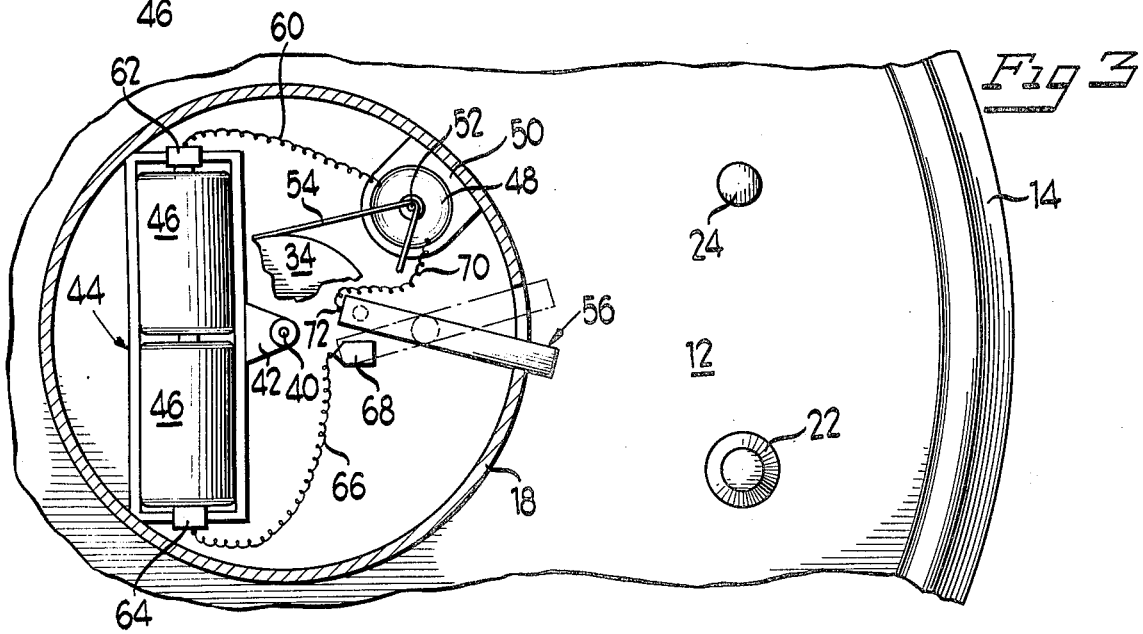
FIG. 3 is a fragmentary horizontal sectional view taken generally along line 3—3 of FIG. 2.

FIG. 3 shows the wiring of the batteries 46, motor 48, and on-off switch 56. It can be seen that the motor 48 is connected by means of a conductor 60 to one end contact 62 of a pair of the batteries 46. Another contact 64 at the opposite end of the pair of batteries is connected by a conductor 66 to a switch contact 68 which is fixed to the top of the game board within the housing 18. The motor 48 also is connected by way of a conductor 70 to one end of the switch 56, as at 72, whereby the switch can be moved from an off position (shown in full lines in FIG. 3) to an on position (shown in phantom in FIG. 3), the latter position having the switch 56 making engagement with the fixed contact 68.

It is apparent that with the device of the present invention, more positive action is provided which requires specific timing and manual manipulation by the players of the game so as to drop a ball into the funnel shaped portion 28 of the ball propelling device and have the ball propelling device immediately propel a ball through the chute portion 30 thereof outwardly in engagement with one of the upstanding target members 22. By elevating the ball propelling device (by means of the housing 18) above the game board 12, the ball can strike the target members at a position above the game board to knock the target members over positively, rather than through ricocheting action. The degree of timing and manual dexterity enhances the playability of the game. The coding of the position bosses 24 with the target members 22 provides for identification of those targets which a player should attempt to knock over in accordance with the rules of the game.

The foregoing detailed description has been given for clearness of understanding only and no unnecessary limitations should be understood therefrom as some modifications will be obvious to those skilled in the art.

I claim:

1. A game device, comprising: a game board the top of which defines a playing surface with retaining means about the playing surface, a 360° rotary ball propelling device mounted on the game board and having a ball receiving portion disposed generally centrally of a vertical axis of rotation for receiving play balls individually and immediately propelling a ball outwardly therefrom through an elongated, generally horizontally extending chute portion under centrifugal force, a set of play balls adapted to be individually placed into and propelled radially from the ball propelling device, a plurality of individual upright and upwardly elongated target members positionable on the playing surface about the ball propelling device for engagement by a ball propelled by the ball propelling device in an attempt to knock over the target members, wherein said upright target members have recesses in the bottoms thereof, and said playing surface includes a plurality of bosses thereon about the ball propelling device for positioning in said recesses to define proper positions for the target members, said ball propelling device being mounted on top of a housing mounted on the playing surface so as to elevate the chute portion of the ball propelling device above the playing surface so as to propel a ball through the air in an attempt to strike one of said target members at a point above the playing surface in said attempt to knock over the target members, and constant speed power means disposed within said housing in operative association with the ball propelling device thereabove for continuously and uniformly rotating the ball propelling device during the play of the game whereby a player may selectively place a ball in the powered ball propelling device in a timed relationship to permit the device to immediately propel the ball outwardly therefrom through the air toward a selected target member so that a player can effectively aim his "shots" by properly timing the placing of a ball in the propelling device in an attempt to knock over selective ones of said target members.

2. The game device of claim 1 wherein said target members comprise elongated frusto-conical members having a generally flat enlarged base portion positionable on said playing surface about said boss.

* * * * *